US005934108A

United States Patent [19]

Berns'Au

[11] Patent Number: 5,934,108

[45] Date of Patent: Aug. 10, 1999

[54] YARN STEAMING MACHINE

[76] Inventor: Gebhard Berns'Au, Im Diengau 3, Hohentengen, Germany

[21] Appl. No.: 09/072,214

[22] Filed: May 4, 1998

Related U.S. Application Data

[63] Continuation of application No. PCT/EP97/04773, Sep. 2, 1997.

[30] Foreign Application Priority Data

Sep. 11, 1996 [DE] Germany ..... 196 36 833

[51] Int. Cl.[6] ..... D06B 3/06; D06B 23/00

[52] U.S. Cl. ..... 68/5 D

[58] Field of Search ..... 68/5 D, 5 E

[56] References Cited

U.S. PATENT DOCUMENTS 3,318,013 5/1967 Erb ..... 68/5 D X
3,659,439 5/1972 Tindall ..... 68/5 D
3,696,642 10/1972 Rigacci ..... 68/5 D
4,169,707 10/1979 Gloeckler ..... 68/5 D X

FOREIGN PATENT DOCUMENTS 2022158 12/1979 United Kingdom ..... 68/5 D

*Primary Examiner*—Philip R. Coe
*Attorney, Agent, or Firm*—Barry R. Lipsitz

[57] ABSTRACT

In order to improve a yarn steaming machine comprising a steaming device, a conveyor device for conveying yarn laid in the form of a yarn loop layer through the steaming device, a loop forming device, which forms the yarn loop layer, and a draw-off device, which breaks up the yarn loop layer following its passage through the steaming device by drawing off the yarn, such that the yarn loop layer is formed as reliably and with as little trouble as possible, it is proposed that the loop forming device be provided with a rotating winding flyer which winds a delivered yarn around a winding head, that the winding head be rotatably mounted on the winding flyer, and that the winding head be inhibited in a non-contacting manner from rotating with the winding flyer.

31 Claims, 7 Drawing Sheets

10
12
14
16
18
20
22
24
25
30
32
34
36
38
40
42
44
46
50
52
54
58
60
62
64
70
80
144
146
148
150

160
32
56
58
162
30'
46
42
166
54
164
52'
50'
182
178
176
180
7
7
168
70'
80

YARN STEAMING MACHINE

This application is a continuation of International PCT Application No. PCT/EP97/04773 filed on Sep. 2, 1997.

BACKGROUND OF THE INVENTION

The invention relates to a yarn steaming machine comprising a steaming device, a conveyor device for conveying yarn laid in the form of a yarn loop layer through the steaming device, a loop forming device, which forms the yarn loop layer, and a draw-off device, which breaks up the yarn loop layer following its passage through the steaming device by drawing off the yarn.

Machines of this kind are known from the prior art, in the case of which machines either the loop forming device fails to operate reliably or the draw-off device does not break up the yarn loop layer trouble-free.

SUMMARY OF THE INVENTION

The object of the invention is therefore to improve a yarn steaming machine of the type according to the preamble such that the yarn loop layer is formed as reliably and with as little trouble as possible.

This object is solved according to the invention in a yarn steaming machine of the type initially described in that the loop forming device comprises a rotating winding flyer which winds a delivered yarn around a winding head, that the winding head is rotatably mounted on the winding flyer, and that the winding head is inhibited in a non-contacting manner from rotating with the winding flyer.

The advantage of the solution according to the invention lies in the fact that yarn loops are reliably formed by winding the yarn onto the winding head, that the yarn is faultlessly drawn off the winding flyer to form the yarn loops through the non-contacting inhibition of the winding head from rotating with the winding flyer, and that these yarn loops can be deposited from the winding head to form the yarn loop layer.

The winding head does not in principle have to be stationary. It is even appropriate and advantageous for the winding head to be able to execute a slight rotational movement in order, for example, to smoothly absorb an irregularity in the process of drawing the yarn off the winding flyer. It is, however, advantageous if the winding head is inhibited such that a rotational movement of the latter lies within a maximum rotational angle range of 360°, which means that when the loop forming device is operating the winding head does not execute a rotational movement which exceeds one rotation about itself.

It is particularly advantageous for the maximum rotational angle range within which the winding head rotates during operation to be 45°.

The winding head can be inhibited from co-rotating in a non-contacting manner in a wide variety of ways. Hence all mechanical non-contacting interactions, for example including an air stream acting on the winding head, are conceivable. A particularly advantageous solution for inhibiting the winding head from co-rotating lies in achieving this by means of a magnetic field.

Various interactions can be achieved by means of a magnetic field. For example, the winding head can be inhibited from co-rotating by producing eddy currents, i.e. according to the eddy current brake principle, for example.

According to an especially advantageous solution, which is preferred in particular on account of its simplicity, the winding head is inhibited from rotating with the winding flyer through a magnetostatic attraction between a magnet and a body which is attracted by the latter, one of these being disposed in a non-rotatable manner on the machine frame and the other being disposed on the winding body. This solution is a particularly simple and therefore inexpensive method of inhibiting the winding head.

It is basically possible to dispose the magnet in the winding head. According to a particularly favourable possibility, however, the magnet is disposed in a non-rotatable manner on the machine frame, as this offers the possibility, for example, of also using an electro-magnet.

According to another solution, which is particularly favourable as regards the holding force which can be produced to inhibit the rotational movement of the winding head, the body which is attracted by the magnet is also a magnet, so that the particularly intense interaction between two magnets is used to inhibit the rotational movement.

In this respect it is of great advantage, for example for reasons of simplicity of solution and low costs, for each magnet to be a permanent magnet.

No detailed particulars regarding the position and orientation of the magnetic field have yet been provided. According to a particularly advantageous solution, the magnetic field passes through a winding surface of the winding head, i.e. the surface of the winding head onto which the yarn loop is wound by means of the winding flyer. Such an orientation of the magnetic field is particularly favourable in order to achieve a large holding moment to inhibit the winding head from co-rotating on account of the usable radial distance from the rotational axis.

No detailed particulars regarding the construction of the actual winding head have yet been provided. The winding head could basically have a circular cylindrical surface of a constant diameter as the winding surface. According to a particularly advantageous solution, a winding surface of the winding head has a greater diameter in a loop winding region than in a loop deposit region. This kind of winding head construction makes it easier to detach the yarn loop from the winding surface and deposit it in the form of the yarn loop layer under the effect of gravity.

A solution in which the winding head comprises at least one step between the loop winding region and the loop deposit region would basically be possible here. However a plurality of steps would also be conceivable. According to a particularly favourable solution, the diameter of the winding surface decreases, preferably continuously, from the loop winding region in the direction of the loop deposit region as the distance from the loop winding region increases. This is a particularly simple way of assisting a movement of the yarn loop laid on the winding surface in the loop winding region towards the loop deposit region, with the movement of the yarn loops towards the loop deposit region taking place under the effect of gravity.

No detailed particulars regarding the arrangement of the winding head have yet been provided. It would be possible, for example, to dispose the winding head at a distance from the conveyor device and let the yarn loops fall freely from the winding head onto the conveyor device.

According to a particularly favourable embodiment, in order to enable the yarn loops formed at the winding head to be deposited on the conveyor device as true to shape as possible, the winding head is formed so as to deposit the yarn loops directly as a yarn loop layer on the conveyor device.

In this respect a particular feature lies in the winding head depositing the yarn loops directly on a conveyor belt of the conveyor device.

In the simplest case this can be achieved in construction terms in that the winding head is disposed with an end face facing the conveyor device, i.e. in particular the conveyor belt of the latter.

In addition or alternatively to the object initially mentioned, the invention is also based on the object of improving a yarn steaming machine of the type according to the preamble such that the yarn can be drawn off the yarn loop layer in order to break up the latter easily and trouble-free.

This object is solved according to the invention in a yarn steaming machine of the type initially described in that a turning device is disposed before the draw-off device to make an underside of the yarn loop layer lying on the conveyor device accessible for drawing off the yarn.

The advantage of this solution lies in the fact that it obviates the necessity of drawing the yarn out of the yarn loop layer such that the draw-off device always draws off the very bottom yarn loop of the yarn loop layer and thus disturbs and distorts the overlying yarn loops of the yarn loop layer, ultimately resulting in a disturbance of the take-off.

The simplest way of making the underside of the yarn loop layer accessible consists in the turning device laying the yarn loop layer on its top side which is remote from the conveyor device, so that the underside is accessible for drawing off the yarn loop still lying at the very bottom on the conveyor device.

The turning device could, for example, operate such that the yarn loop layer turns about an axis pointing approximately in the conveying direction in order to make the underside of this layer accessible.

A turning device which is particularly simple and of a compact construction and which enables the yarn loop layer to be reversed trouble-free is provided with a turning wheel which takes up the yarn loop layer.

This turning wheel may in principle comprise any type of contact surface for turning the yarn loop layer. For example, the turning wheel may be rotatable about an axis which is oriented in any desired manner with respect to a conveying plane of the yarn loop layer in the conveying device.

According to a particularly simple embodiment, the turning wheel can be rotated about an axis which extends approximately parallel to a conveying plane of the conveyor device.

In order to be able to remove the yarn loop layer from the conveyor device trouble-free, the yarn loop layer can be removed from the conveyor device by a gas stream which acts on the layer. A gas stream of this kind provides the possibility, in a simple and sufficiently gentle manner, of removing the yarn loop layer from the conveyor device and delivering it to the turning wheel.

It is then particularly appropriate if the yarn loop layer can be fixed at a contact surface of the turning wheel by the gas stream, i.e. can be pressed against the contact surface of the turning wheel by the gas stream.

The gas stream is chiefly only employed to remove the yarn loop layer from the conveyor device. Provision is therefore appropriately made for the gas stream to fix the yarn loop layer in a first contact segment of the turning wheel at the contact surface thereof.

For example, in order to lay the yarn loop layer on the contact surface of the turning wheel, it would be possible to direct the gas stream at the yarn loop layer and to blow against this such that it is subjected to a force which acts against the contact surface.

It is, however, particularly advantageous for the contact surface of the turning wheel to comprise passages through which the gas stream passes. This means that not only does the gas stream act upon the yarn loop layer, but also passes through this and the contact surface of the turning wheel, so that the yarn loop layer is sucked against the contact surface of the turning wheel, so to speak.

Moreover, a gas stream of this kind may also advantageously be used to carry out an additional, final treatment of the yarn loop layer, for example additional final drying of the yarn loop layer after the steaming zone.

In order on the one hand to provide a contact surface on the turning wheel, yet on the other to have the passages available for the gas stream, the turning wheel preferably comprises web elements forming the contact surface and the passages. The yarn loop layer therefore on the one hand lies on the web elements and on the other—because the gas stream passes through the passages—is sucked into the passages and is thus more securely fixed against the contact surface of the turning wheel so as to be carried along by the latter.

In order subsequently to detach the yarn loop layer or the yarn loops from the contact surface of the turning wheel in a trouble-free manner during the drawing-off process, the web elements preferably have edges which are rounded towards the passages.

In order to additionally fix the yarn loop layer at the turning wheel, the yarn loop layer is held against the contact surface by a contact bow in a second contact segment following the first contact segment. It is thus possible to secure the yarn loop layer at the turning wheel in a simple manner.

The yarn could be drawn off to break up the yarn loop layer after the turning device. It is, however, particularly favourable for the yarn to be drawn off while still in the region of the turning device, so that the yarn steaming machine can be constructed in a particularly compact manner.

In order also to enable the yarn to be drawn off reliably and securely by means of the draw-off device, the yarn loop layer is preferably acted upon by a pressure bow in the direction of the contact surface of the turning wheel in a third contact segment of the turning device, in which the yarn is drawn off. This ensures that the yarn loop layer is also broken up in a controlled manner by drawing off the individual yarn loops.

The construction of the actual winding flyer of the yarn steaming machine according to the invention has not yet been specified in detail. For example, in this case all forms of a winding flyer which takes up a yarn in the region of the rotational axis and guides it to a yarn outlet rotating in a circular path about the rotational axis are conceivable.

In the simplest case the winding flyer may be formed by an appropriately bent tube which forms the guide duct for the yarn.

However, according to a particularly advantageous solution of a yarn steaming machine according to the invention, the winding flyer guides the yarn between guide eyes in a free-running, i.e. non-contacting manner. This kind of winding flyer construction has the advantage of permitting a reduction in the friction for guiding the yarn, which means that less fuzz is also rubbed off the yarn.

According to a particularly favourable solution in this respect, the yarn is guided in the winding flyer through a central deflector eye and an end guide eye disposed at the yarn outlet. The advantage of this central deflector eye and the end guide eye as well as the yarn guided in a free-running manner between these lies in the fact that the required deflection of the yarn from its position near the rotational axis of the winding flyer into a predetermined position on the circular path, described by the yarn outlet, is achieved with the least possible fuzz formation and therefore also with a very slight probability of the guide duct becoming blocked with fuzz in this region.

It is particularly favourable for the winding flyer also to have a guide eye on the inlet side which is disposed before the central deflector eye and therefore firstly receives the yarn very near the rotational axis and then guides it in a free-running manner to the deflector eye, the latter preferably already guiding the yarn at a substantial radial distance from the rotational axis.

It is especially appropriate—particularly to prevent the yarn outlet from becoming clogged with yarn fuzz—for the winding flyer to comprise a yarn outlet which is widened and elongate in the azimuthal direction for the yarn which is delivered and is to be wound onto the winding head. This makes it possible for any fuzz resulting at the yarn outlet to emerge and be carried away without any problems, and it is also possible to facilitate the emergence of fuzz from the guide duct leading to the yarn outlet.

According to a particularly favourable solution, the winding flyer comprises a plurality of yarn outlets for the delivered yarn. This plurality of yarn outlets increases the possibility of carrying fuzz out of the region of the yarn outlet and guide ducts lying before the latter.

According to a further, improved embodiment, the winding flyer comprises a guide duct which is widened and elongate in the azimuthal direction for the yarn which is delivered, so that it is also easier to carry away fuzz resulting in the region of the guide duct.

According to a particularly favourable solution, the winding flyer comprises a guide duct which is azimuthally closed, circulates around the rotational axis and leads to the yarn outlets.

No detailed particulars regarding the construction of the yarn outlets have yet been provided. The construction of the guide eye in particular has not been specified in detail. It would, for example, be possible to line the entire yarn outlet with the end guide eye. According to a particularly advantageous solution, the yarn outlet, viewed in the azimuthal direction, comprises at the end a U-shaped guide eye for the yarn. On the one hand this solution enables the U-shaped guide eye to be easily inserted in the end region of the yarn outlet and on the other has the advantage of enabling the guide eye to be of a small construction and of the yarn always passing through this, since the yarn always bears against one end of the yarn outlet, viewed in the azimuthal direction, when the winding flyer rotates.

According to a particularly appropriate solution, which is particularly independent of the rotational direction of the winding flyer, the yarn outlet comprises a U-shaped guide eye for the yarn at both ends.

The special construction of the winding flyer has not been defined in detail, with the exception of the guidance of the yarn in this flyer in connection with the embodiments so far described. As before, in the simplest case the winding flyer could be constructed as a kind of tube which forms, for example, the widened guide duct and bears the guide eyes.

However, according to a solution which is particularly advantageous in construction terms, the winding flyer is formed by a flyer bell whose bottom closure forms the yarn outlet. This means that instead of the necessity of providing a guide tube for the yarn, the winding flyer is formed by the actual guide bell with the yarn outlet, which is guided along the circular path by the latter.

The flyer bell could in principle be internally hollow and just closed by the bottom closure.

However, in order to enable the yarn to be introduced more easily and also to achieve a flow through the guide duct as far as possible without the formation of fuzz clusters, according to an advantageous embodiment the guide bell is provided with an inner body which rises above the bottom closure and which forms the guide duct between itself and the flyer bell, with the guide duct in this case advantageously being formed such that it circulates azimuthally about the rotational axis.

The following description and the graphic representations of several embodiments relate to further features and advantages.

DETAILED DESCRIPTION OF THE INVENTION

Figure 1:
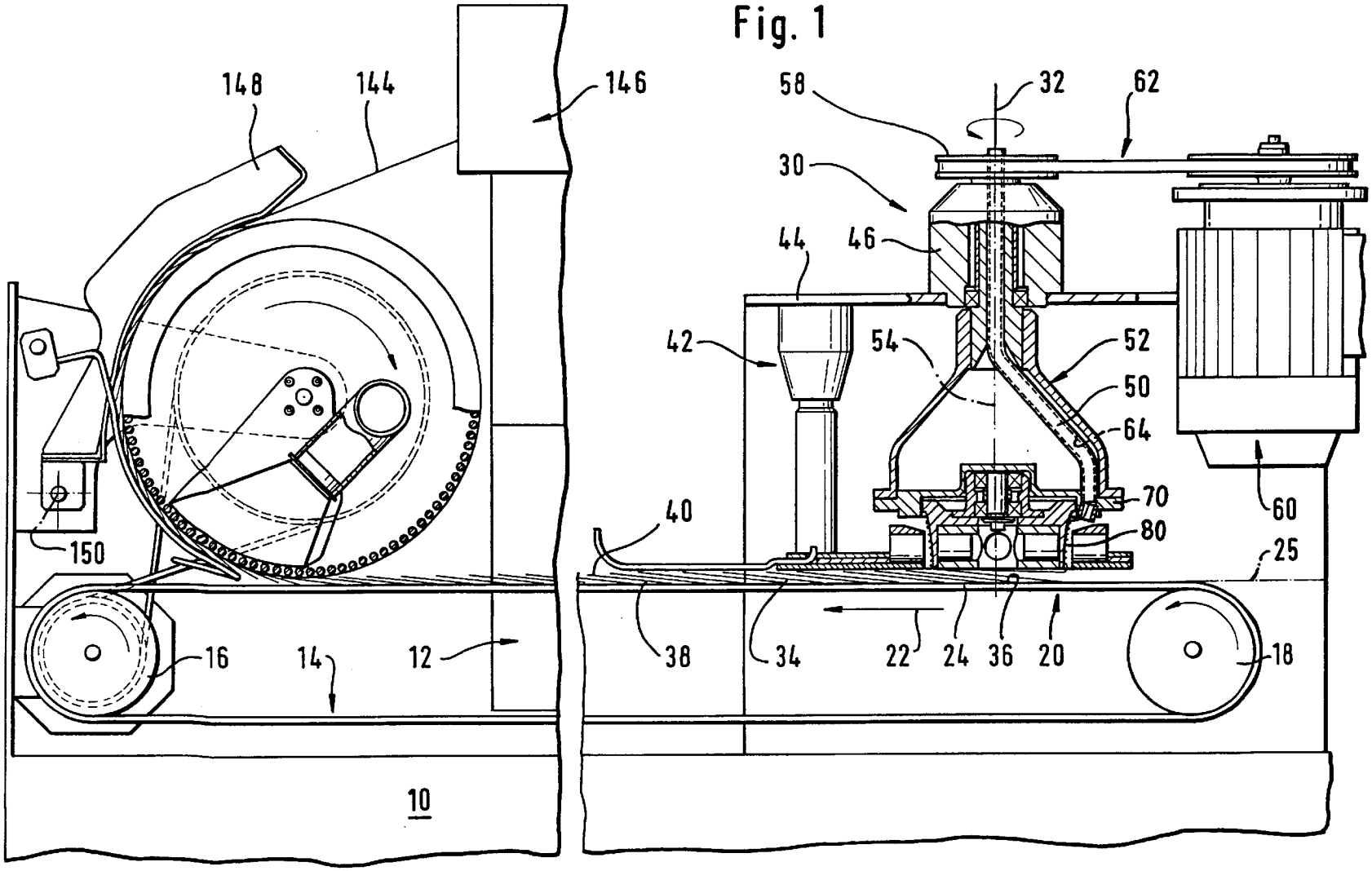
FIG. 1 is a part-sectional side view of a first embodiment of a yarn steaming machine according to the invention.
Figure 2:
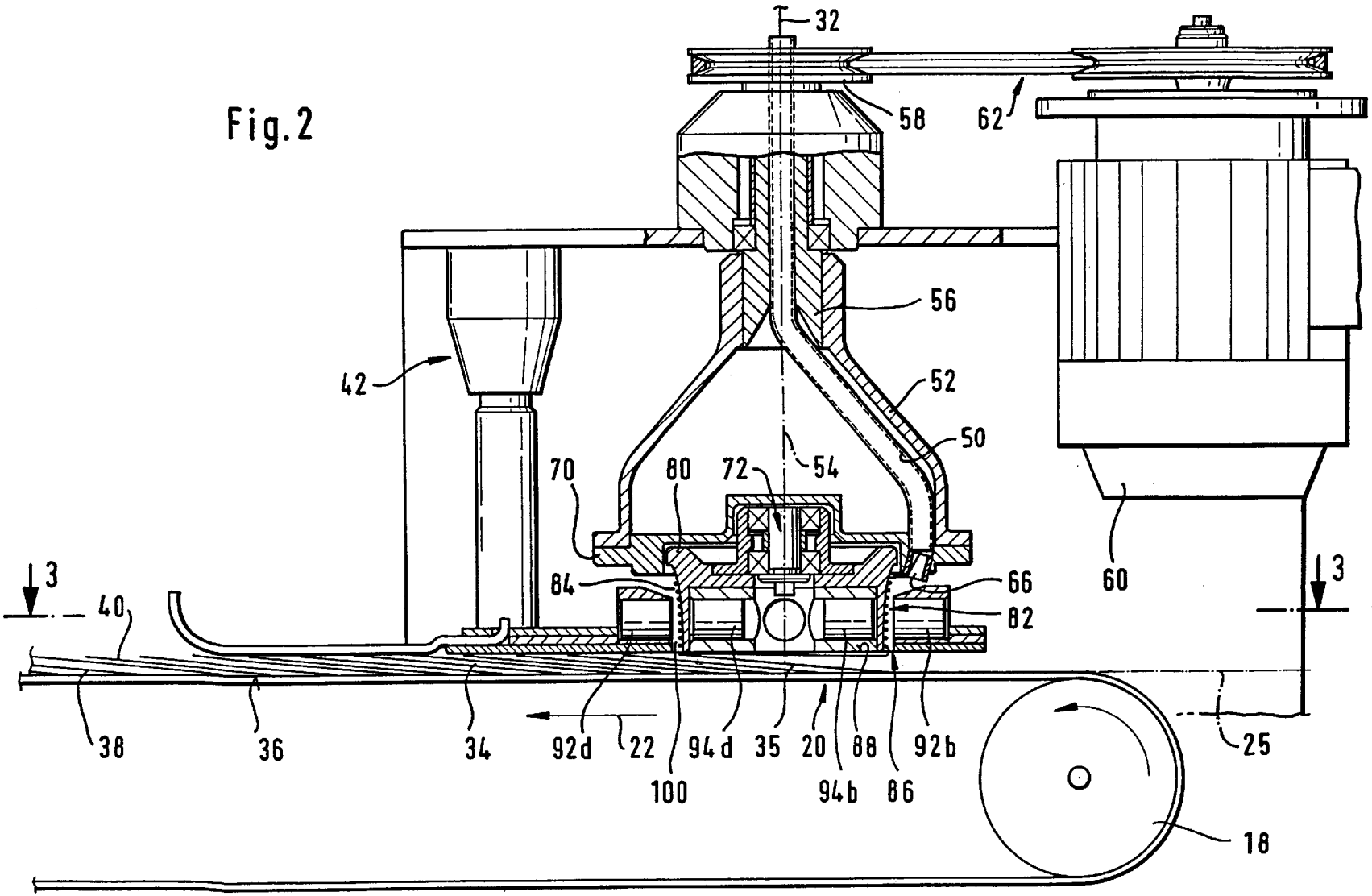
FIG. 2 is an enlarged representation of the section according to FIG. 1 in the region of a loop forming device.
Figure 3:
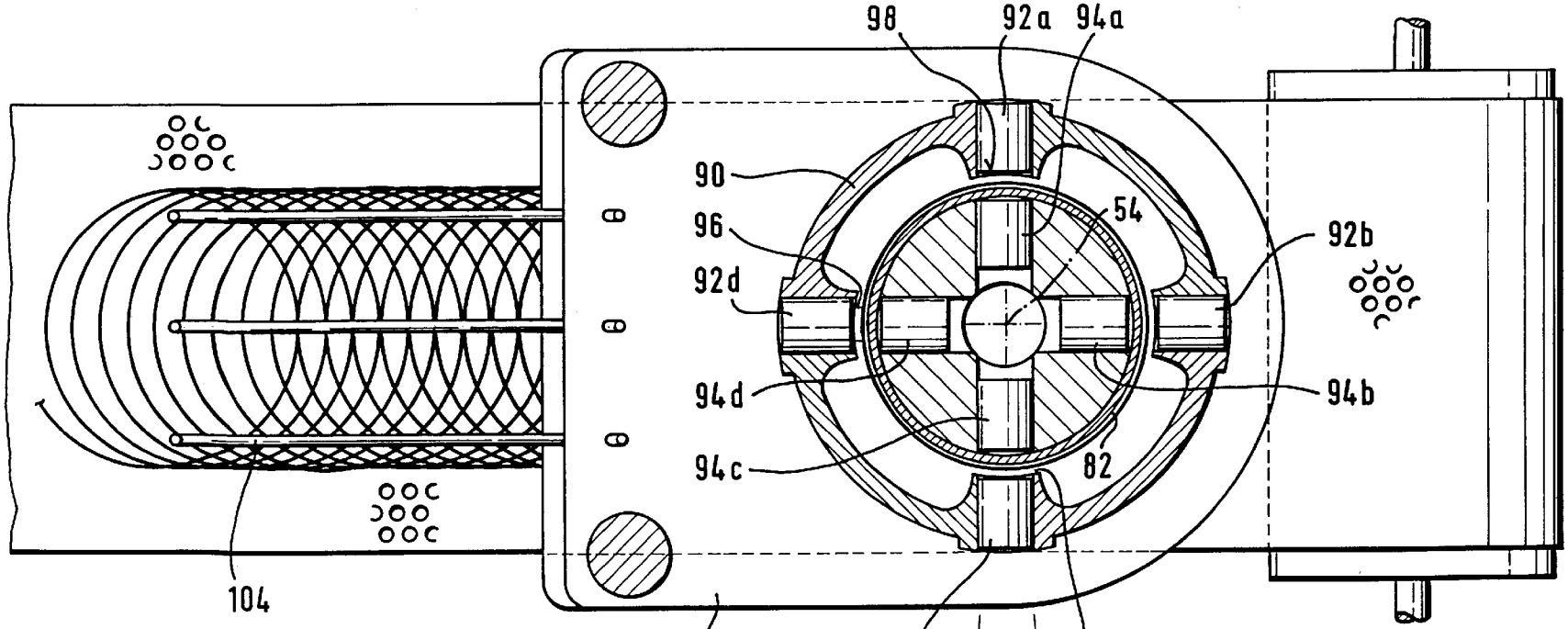
FIG. 3 is a section along the line 3—3 in FIG. 2.

A first embodiment of a yarn steaming machine according to the invention, as represented in FIG. 1, comprises a machine frame which is designated as a whole by 10 and on which, for example, a steaming device comprising a preheating zone and a steaming zone for yarn is disposed. Also held on the machine frame 10 is a conveyor device which is designated as a whole by 14 and which comprises two rollers 16 and 18 which are disposed at a distance from one another in the horizontal direction and over which a conveyor belt 20 passes, the latter extending with a carrying run 24 in a conveying direction 22 and the carrying run 24 forming a delivery plane 25 and passing through the steaming device 12.

Viewed in the conveying direction 22, the steaming device 12 is preceded by a loop forming device which is designated as a whole by 30 and which deposits a delivered yarn 32 in the form of a yarn loop layer 34 consisting of yarn loops 35 which, although linked together, are staggered relative to one another with respect to the conveying direction 22, on a top side 36 of the carrying run 24 of the conveyor belt 20 such that the yarn loop layer 34 lies with its underside 38 on the top side 36 of the conveyor belt 20, while new yarn loops 35 are constantly laid by the loop forming device 30 on a top side 40 of the yarn loop layer 34 at an end of the latter which faces the loop forming device 30, so that each newly laid yarn loop 35 lies on the yarn loop 35 laid before it in each case.

The loop forming device 30 in turn comprises a column 42 which is held on the machine frame 10 and which has a bearing plate 44 with a bearing support 46, in which a flyer bell 52 comprising a winding flyer 50 is mounted such that it can rotate about an axis 54 in the region of a shaft section 56 passing through the bearing support 46. On its side which is distant from the flyer bell 52 the shaft section 56 bears a belt pulley 58, which is part of a belt drive 62 driven by a winding motor 60.

The winding motor 60 is also held on the bearing plate 44, for example.

Both the belt pulley 58 as well as the shaft section 56 and the flyer bell 52 are penetrated by a guide tube 64, which forms the winding flyer 50, for the yarn 32, and which ends at a radial distance from the axis 54 with a yarn outlet 66.

The flyer bell 52 preferably comprises a bottom closure 70, on which a winding head, designated as a whole by 80, is mounted via a pivot bearing 72, which head can rotate relative to the flyer bell 52 on account of the pivot bearing 72.

The winding head 80 is preferably also disposed such that it can rotate by means of the pivot bearing 72 coaxially with the flyer bell 52 and comprises an outer cylinder-like winding surface 82, which is disposed at the circumference, extends coaxially and with rotational symmetry with respect to the axis 54 and comprises on one side a loop winding region 84, which faces the yarn outlet 66, and on the other a loop deposit region 86, which faces the yarn loop layer 34, with the diameter of the winding surface 82 decreasing continuously, in the simplest case like a cone, from the loop winding region 84 towards the loop deposit region 86. The yarn loops 35 applied to the winding surface 82 by the winding flyer 50 in the loop winding region 84 therefore run in the direction of the loop deposit region 86 and are deposited by the latter, with the conveyor belt 20 running in the conveying direction 22, as a yarn loop layer 34 with yarn loops 35 which are superimposed, yet staggered in the conveying direction 22.

The winding head 80 is preferably disposed such that one end face 88 of the latter is located at a distance above the top side 36 of the conveyor belt 20 which is slightly greater than the thickness of the yarn loop layer 34 which can be obtained.

The winding head 80, which can rotate with respect to the flyer bell 52 on account of the pivot bearing 72, is inhibited in a non-contacting manner from rotating with the flyer bell 52, in particular on account of the yarn loops wound up in the loop winding region 84, this being effected by magnets 92*a* to 92*d* which are disposed in a magnet holder ring 90 at angular spacings of 90° about the rotational axis 54 and which interact in pairs in a non-contacting manner with magnets 94*a* to *d*, which are disposed at corresponding angular spacings in the winding head 80, via a magnetic field 96 passing through the winding surface 82 and thus inhibit the rotational movement of the winding head 80 about the axis 54.

The magnet holder ring 90 is preferably disposed such that it embraces the winding head 80 in the region of its winding surface 82, with end faces 98, which face the winding surface 82, of the magnets 92*a* to *d* extending at a distance from the winding surface 82, thus forming an intermediate space 100 which is of a size such that the yarn loops which are wound up on the loop winding region 84 can move without hindrance in the direction of the loop deposit region 86 of the winding surface.

The non-contacting inhibition of the co-rotation of the winding head 80 with the flyer bell 52 preferably gives rise to rotational oscillatory movements of the winding head 80 about the axis 54, with an oscillatory turn of the winding head 80 within a rotational angle range W of a maximum of 5°.

The magnet holding ring 90 is preferably held on a base plate 102 of the loop forming device 30 which is connected to the column 42.

Holding-down mechanisms 104 extend from the base plate 102 in the conveying direction 22, these mechanisms 104 acting on the top side 40 of the yarn loop layer 34 in order to hold the yarn loop layer 34 with its underside 38 against the top side 36 of the carrying run 24.

Figure 4:
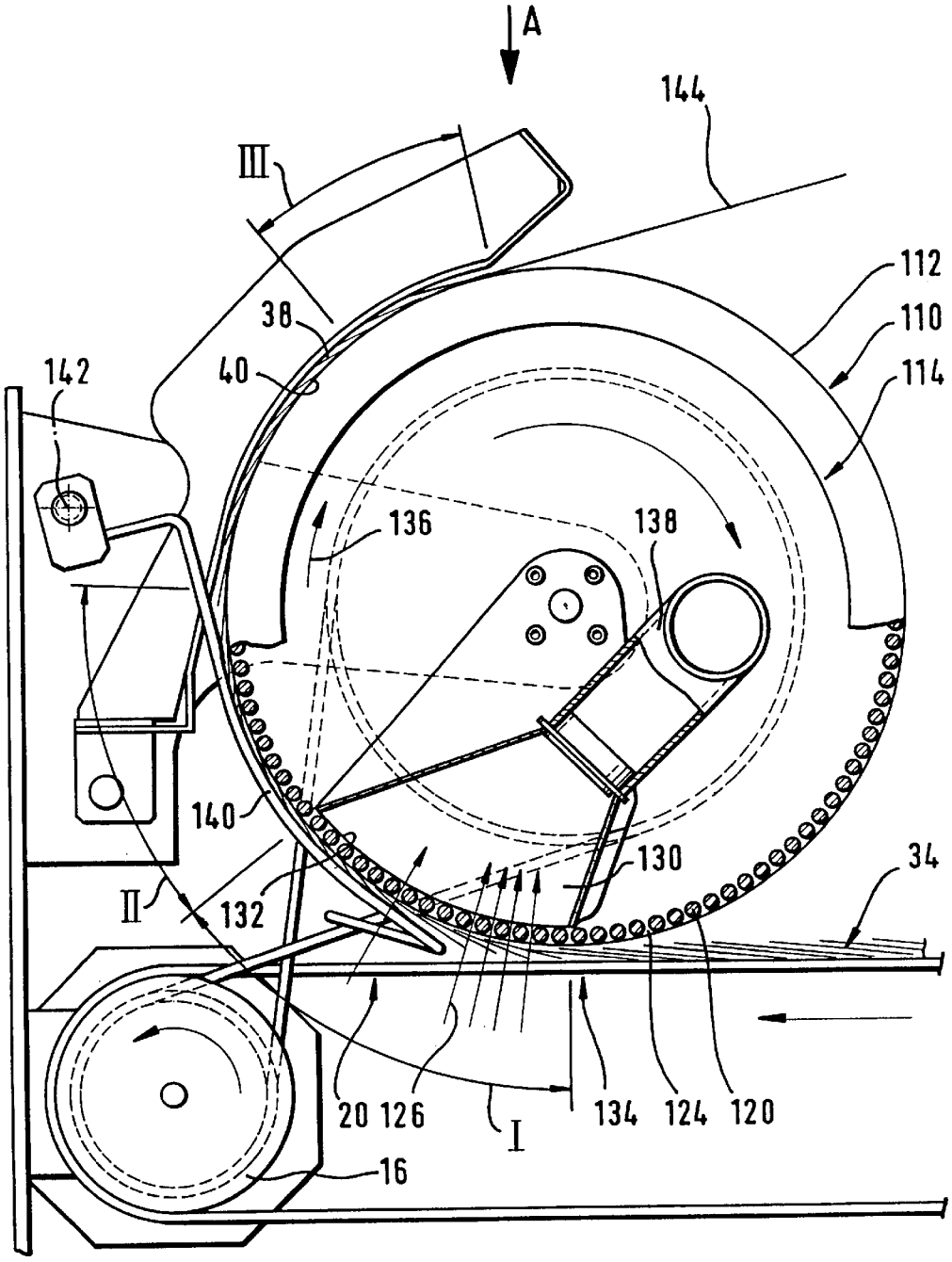
FIG. 4 is an enlarged side view of the yarn steaming machine according to FIG. 1 in the region of a turning device.
Figure 5:
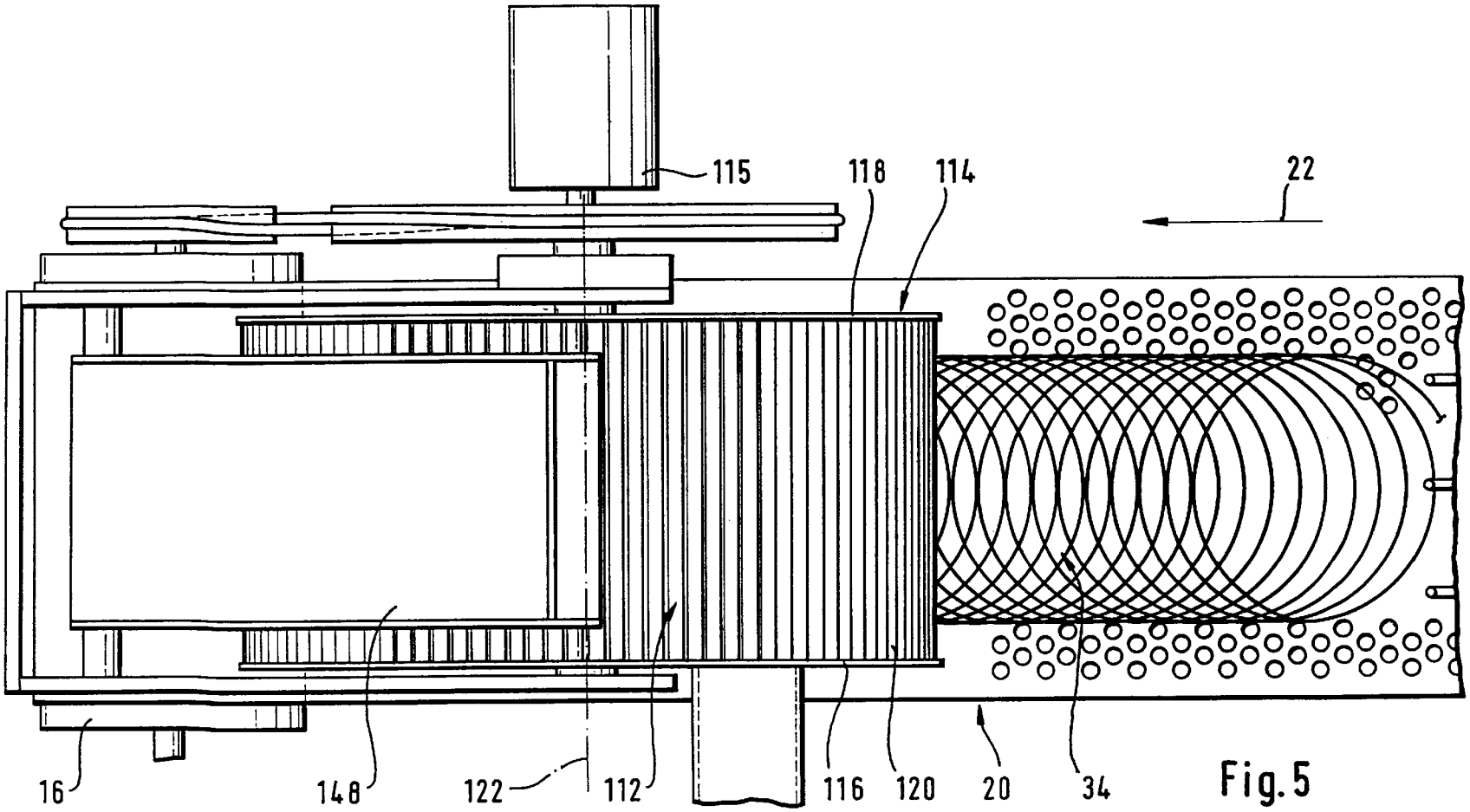
FIG. 5 is a plan view in the direction of the arrow A in FIG. 4.

As shown in FIGS. 1 and 4, the yarn loop layer 34, which is guided through the steaming device 12 by the perforated conveyor belt 20, is taken up by a turning device, which is designated as a whole by 110, and reversed such that the underside 38 of the yarn loop layer 34 lies at the top and is freely accessible for drawing off the yarn, while the top side 40 of the yarn loop layer 34 lies on a contact surface 112 of a turning wheel 114 comprised by the turning device 110. The turning wheel 114 can be driven together with the roller 16 by means of a motor 115 (FIG. 5).

The contact surface 112 of the turning wheel is formed by a plurality of round material rods 120 extending between two turning wheel disks 116 and 118, the round material rods 120 extending with their longitudinal axis approximately parallel to a rotational axis 122 of the turning wheel and being disposed at a distance from one another in the azimuthal direction, so that the contact surface 112 has an undulating contour and passages 124 are created between the round material rods 120, through which passages an air stream 126, which is to be described in detail in the following, can pass.

An air intake hopper 130 is provided inside the turning wheel 114 to take up the yarn loop layer 34 from the conveyor belt 20, the opening 132 of which hopper extends at an inner side of the round material rods 120 over an angular range of approximately 45°, this angular range forming a first contact segment I which, starting from a tangent point 134, at which the contact surface 112 of the turning wheel 114 bears on a top side 40 of the yarn loop layer 34 lying on the conveyor belt 20, extends in a rotational direction 136 of the turning wheel 114.

In the course of this first contact segment I the yarn loop layer 34 is taken up and lifted off the conveyor belt 20 by a suction fan, which is not shown in the drawings and is connected via a suction line 138 to the air intake hopper 130, so that the air stream 126 penetrating the passages 124 in the first contact segment I cases the yarn loop layer 34 to be fixed with its top side 40 on the contact surface 112 of the turning wheel 114 and thus lifted off the conveyor belt 20.

After being lifted off the conveyor belt 20, the yarn loop layer 34 fixed on the contact surface 112 by the air stream is held by means of a contact bow 140 in the course of a second contact segment II against the contact surface 112, which contact bow 140 is mounted such that it can rotate about an axis 142 for pivoting in the direction of the yarn loop layer and is subjected to a torque in this direction, so that a defined contact force acting on the yarn loop layer 34 can be set. The second contact segment II extends in the rotational direction of the turning wheel 114 following the first contact segment I, with the yarn loop layer 34 being held by the contact force against the contact surface 112 of the turning wheel 114 in the region of the second contact segment II and therefore being conveyed with this wheel.

The turning wheel 114 conveys the yarn loop layer 34 further from the second contact segment II in the rotational direction 136 to a third contact segment III, in the region of which the yarn loops 35 of the yarn loop layer 34 still lying on the turning wheel 114 are drawn off in the form of a yarn 144 by a draw-off device 146 represented diagrammatically in FIG. 1. The yarn loop layer 34 is preferably also acted upon in the third contact segment by a pressure bow 148, which is likewise mounted in a flexible manner about an axis 150 on the machine frame 10 and, essentially on the basis of its own weight, exerts a pressure on the yarn loop layer 34 in the third contact segment III such that the yarn loop layer 34 is broken up by drawing off the individual yarn loops successively, namely yarn loop 35 by yarn loop 35, and, due to the turning wheel 114, the yarn loop 35 which is in each case to be drawn off next represents the top yarn loop 35 lying on the side of this end of the yarn loop layer 34 which is distant from the contact surface 112 and can thus be drawn off without disturbing the individual yarn loops 35 of the yarn loop layer 34.

In a second embodiment of a yarn steaming machine according to the invention the parts which are identical to those of the first embodiment have been given the same reference numbers, so that the statements relating to the first embodiment can be referred to in their entirety as regards the description of these parts.

Figure 6:
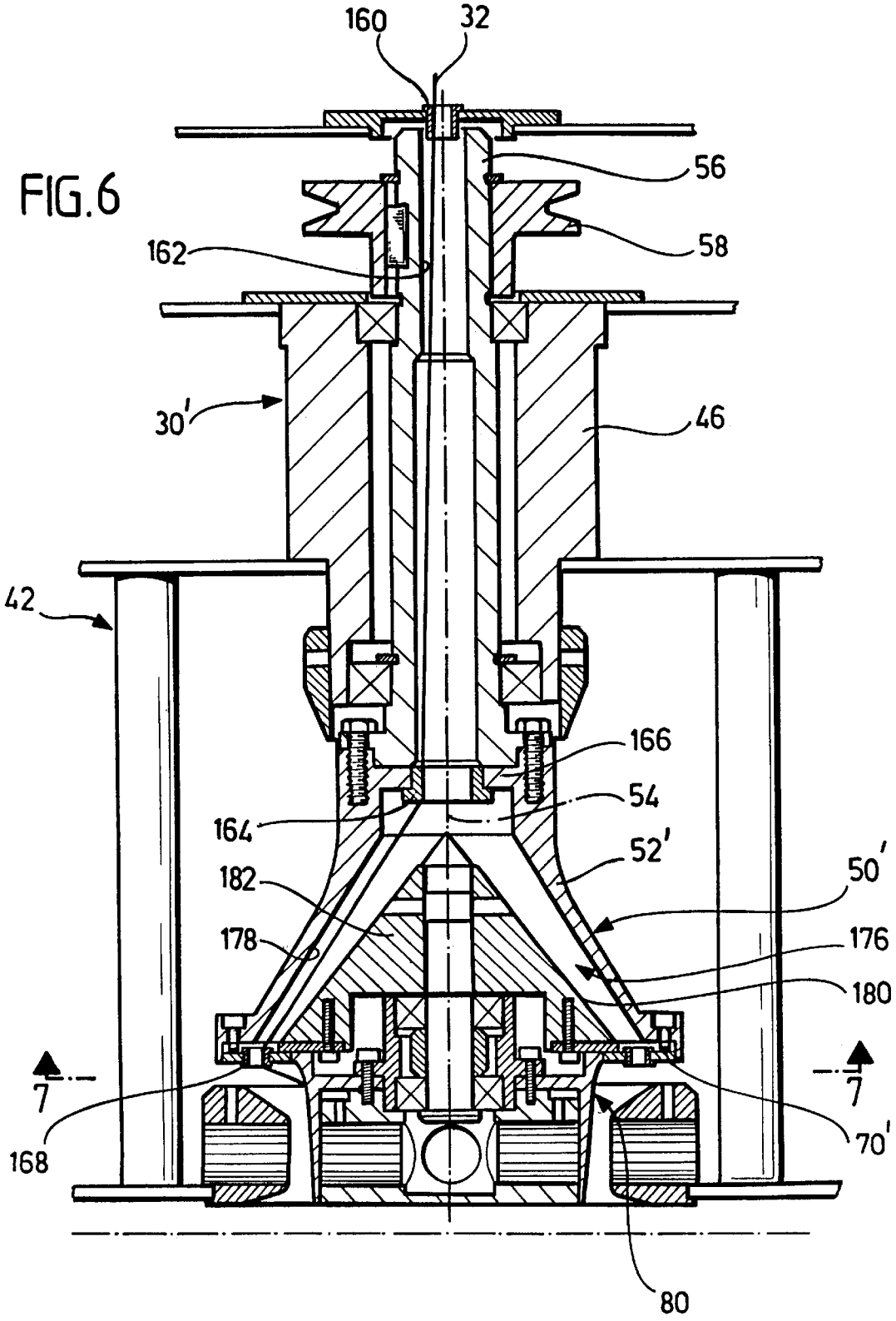
FIG. 6 is a section similar to FIG. 2 through a second embodiment.
Figure 7:
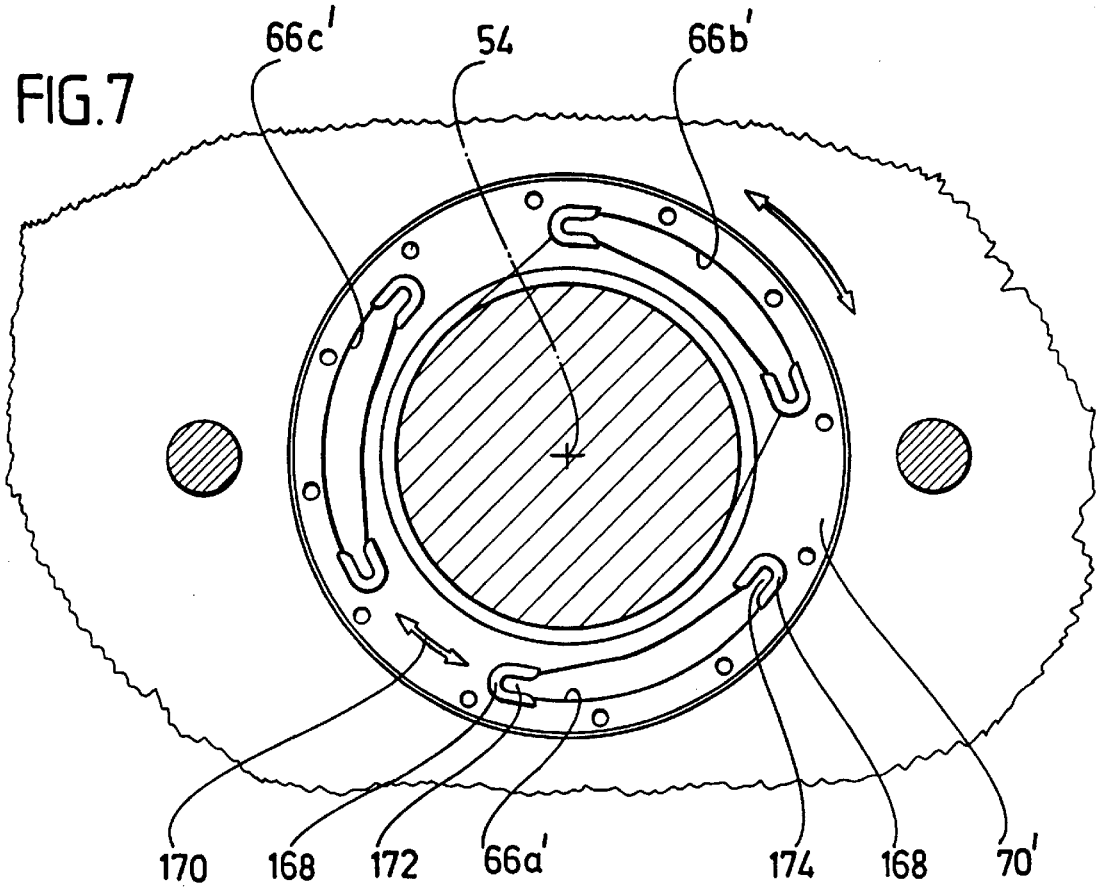
FIG. 7 is a section along the line 7—7 in FIG. 6.

In the second embodiment the loop forming device 30' for forming the yarn loop layer 34 is of a different construction in so far as the delivered yarn 32 is no longer guided in a tubular winding flyer, but instead, as shown in FIG. 6, is guided through a guide eye 160 on the inlet side upon entering a guide duct 162 in the shaft section 56 and runs in this guide duct 162 of the shaft section 56 in a non-contacting manner up to a central guide eye 164, which is disposed in a head part 166 of the flyer bell 52'. A deflection occurs from the central guide eye 164 in a direction transversely to the axis 54 up to an end guide eye 168 provided in the region of the yarn outlet 66', which in this case is provided in the bottom closure 70' of the flyer bell 52'. The yarn outlet 66' is preferably constructed as an opening which is elongate in the azimuthal direction, curved in the form of a circular segment and provided with the U-shaped guide eye 168 in the region of its two ends 172 and 174 lying opposite one another in the azimuthal direction, with the openings of the U-shaped guide eyes facing one another in the azimuthal direction 170, so that the yarn emerging from the yarn outlet 66' runs through one or the other end guide eye 168, irrespective of the rotational direction of the flyer bell 52' about the axis 54.

Here the yarn likewise runs in a non-contacting manner within the flyer bell 52' between the central guide eye 164 and the respective end guide eye 168.

The flyer bell 52' in turn also forms a guide duct 176, which is defined by an inner wall 178 of the guide bell 52' and a conical surface area 180 of an inner body 182 of the flyer bell 52' and extends uninterrupted in the azimuthal direction towards the axis 54.

This guide duct 176 is in each case just closed in sections by the bottom closure 70' of the guide bell 52', except for the yarn outlet 66' provided in this.

Although, generally speaking, it is sufficient just to provide one yarn outlet 66', a plurality of yarn outlets 66'*a* to 66'*c* are preferably provided, these being in particular disposed at equal angular spacings about the axis 54 and likewise extending over the same circular measure in the azimuthal direction 170.

The inner body 182 is preferably seated on the bottom closure 70' of the guide bell 52', with the bottom closure 70' bearing a mounting for the winding head, which is designated as a whole by 80, in the same way as described for the first embodiment.

The guide eyes 160, 164 and 168 are preferably made of a ceramic material, thus reducing the formation of fuzz due to the yarn 32 running along these eyes.

Moreover, the fact that the yarn 32 runs in a non-contacting manner in the guide duct 162 and the guide duct 176 provides the advantage of reduced abrasion of fuzz from the yarn in the region of these ducts, and it is also possible to essentially exclude the likelihood of these becoming clogged with fuzz, as it is always possible to clean the guide ducts 162 and 176 of fuzz in a simple manner by blowing through gas, in particular air.

The fact that the yarn outlets 66' are enlarged in the azimuthal direction and therefore have a greater cross section also has the advantage that fuzz which forms in the guide ducts 162 and 176 can largely be removed and cannot therefore obstruct these on account of its size.

As regards all other aspects, the second embodiment functions in the same way as the first embodiment, so that the statements relating to the first embodiment can be referred to in full in this respect.

What is claimed is:

1. A yarn steaming machine comprising:

a steaming device, a conveyor device for conveying yarn laid in the form of a yarn loop layer through the steaming device, a loop forming device, which forms the yarn loop layer, and a draw-off device, which breaks up the yarn loop layer following its passage through the steaming device by drawing off the yarn, wherein the loop forming device comprises a rotating winding flyer which winds a delivered yarn around a winding head, the winding head,is rotatably mounted on the winding flyer, and the winding head is inhibited in a non-contacting manner from rotating with the winding flyer.

2. A yarn steaming machine according to claim 1, wherein the winding head is inhibited such that a rotational movement of the latter lies within a maximum rotational angle range of 360°.

3. A yarn steaming machine according to claim 2, wherein the maximum rotational angle range of the winding head is 45°.

4. A yarn steaming machine according to claim 1, wherein the winding head is inhibited from rotating with the winding flyer by means of a magnetic field.

5. A yarn steaming machine according to claim 4, wherein the winding head is inhibited from rotating with the winding flyer through a magnetostatic attraction between a magnet and a body which is attracted by the latter, one of the magnet and body being disposed in a non-rotatable manner on the machine frame and the other being disposed on the winding body.

6. A yarn steaming machine according to claim 5, wherein the body which is attracted by the magnet is also a magnet.

7. A yarn steaming machine according to claim 5, wherein the magnet is a permanent magnet.

8. A yarn steaming machine according to claim 4, wherein the magnetic field passes through a winding surface of the winding head.

9. A yarn steaming machine according to claim 1, wherein a winding surface of the winding head has a greater diameter in a loop winding region than in a loop deposit region.

10. A yarn steaming machine according to claim 9, wherein the diameter of the winding surface decreases from the loop winding region in the direction of the loop deposit region as the distance from the loop winding region increases.

11. A yarn steaming machine according to claim 1, wherein the winding head is formed so as to deposit the yarn loops directly as a yarn loop layer on the conveyor device.

12. A yarn steaming machine according to claim 11, wherein the winding head deposits the yarn loops directly on a conveyor belt of the conveyor device.

13. A yarn steaming machine according to claim 1, wherein the winding head is disposed with an end face facing the conveyor device.

14. A yarn steaming machine according to claim 11, wherein the winding flyer guides the yarn between guide eyes in a free-running manner.

15. A yarn steaming machine according to claim 11, wherein the winding flyer comprises a yarn outlet which is elongate in the azimuthal direction for the delivered yarn.

16. A yarn steaming machine comprising:

a steaming device, a conveyor device for conveying yarn laid in the form of a yarn loop layer through the steaming device, a loop forming device, which forms the yarn loop layer, and a draw-off device, which breaks up the yarn loop layer following its passage through the steaming device by drawing off the yarn, wherein:

a turning device is disposed before the draw-off device to make an underside of the yarn loop layer lying on the conveyor device accessible for drawing off the yarn; and the yarn loop layer can be removed from the conveyor device by a gas stream which acts on the layer.

17. A yarn steaming machine according to claim 16, wherein the turning device comprises a turning wheel which takes up the yarn loop layer, and the yarn loop layer can be fixed at a contact surface of the turning wheel by the gas stream.

18. A yarn steaming machine according to claim 17, wherein the gas stream fixes the yarn loop layer in a first contact segment of the turning wheel at the contact surface thereof.

19. A yarn steaming machine according to claim 17, wherein the contact surface of the turning wheel comprises passages through which the gas stream passes.

20. A yarn steaming machine according to claim 19, wherein the turning wheel comprises web elements forming the contact surface and the passages.

21. A yarn steaming machine according to claim 20, wherein the web elements have edges which are rounded towards the passages.

22. A yarn steaming machine according to claim 16, wherein the loop forming device comprises a winding flyer which guides the yarn between guide eyes in a free-running manner.

23. A yarn steaming machine according to claim 22, wherein the yarn is guided in the winding flyer through a central deflector eye and an end guide eye disposed at the yarn outlet.

24. A yarn steaming machine according to claim 22, wherein the winding flyer comprises a yarn outlet which is elongate in the azimuthal direction for the delivered yarn.

25. A yarn steaming machine according to claim 24, wherein the winding flyer comprises a guide duct which is elongate in the azimuthal direction for the delivered yarn.

26. A yarn steaming machine according to claim 24, wherein the yarn outlet, viewed in the azimuthal direction, comprises at the end a U-shaped guide eye for the yarn.

27. A yarn steaming machine according to claim 26, wherein the yarn outlet comprises a U-shaped guide eye for the yarn at both ends.

28. A yarn steaming machine comprising:

a steaming device, a conveyor device for conveying yarn laid in the form of a yarn loop layer through the steaming device, a loop forming device, which forms the yarn loop layer, and a draw-off device, which breaks up the yarn loop layer following its passage through the steaming device by drawing off the yarn, wherein:

a turning device is disposed before the draw-off device to make an underside of the yarn loop layer lying on the conveyor device accessible for drawing off the yarn; and said loop forming device comprises a winding flyer which guides the yarn between guide eyes in a free-running manner.

29. A yarn steaming machine according to claim 28, wherein the winding flyer comprises a plurality of yarn outlets for the delivered yarn.

30. A yarn steaming machine according to claim 28, wherein the winding flyer is formed by a flyer bell whose bottom closure carries the yarn outlet.

31. A yarn steaming machine according to claim 30, wherein the flyer bell is provided with an inner body which rises above the bottom closure and which forms the guide duct between itself and the flyer bell.

* * * * *